United States Patent [19]

Ikeno et al.

[11] 4,175,163

[45] Nov. 20, 1979

[54] STAINLESS STEEL PRODUCTS, SUCH AS SHEETS AND PIPES, HAVING A SURFACE LAYER WITH AN EXCELLENT CORROSION RESISTANCE AND PRODUCTION METHODS THEREFOR

[75] Inventors: Teruo Ikeno, Mitaka; Satoshi Kado, Fujisawa; Yasuo Otoguro, Machida; Yasuhiko Miyoshi, Tokyo; Chuichi Kato; Tadao Azami, both of Sagamihara, all of Japan

[73] Assignee: Nippon Steel Corporation, Tokyo, Japan

[21] Appl. No.: 780,781

[22] Filed: Mar. 24, 1977

[30] Foreign Application Priority Data

| | | | |
|---|---|---|---|
| Mar. 29, 1976 | [JP] | Japan | 51-33498 |
| Apr. 7, 1976 | [JP] | Japan | 51-38929 |
| May 12, 1976 | [JP] | Japan | 51-53939 |

[51] Int. Cl.[2] ..... C09D 5/08

[52] U.S. Cl. ..... 428/553; 106/14.05

[58] Field of Search ..... 428/553; 106/14

[56] References Cited

U.S. PATENT DOCUMENTS

| | | | |
|---|---|---|---|
| 2,855,296 | 10/1958 | Koehring | 428/553 |
| 2,860,098 | 11/1958 | Fahroe et al. | 428/553 |
| 3,312,546 | 4/1967 | Mayer et al. | 428/553 |
| 3,325,259 | 6/1967 | Mayer et al. | 428/553 |
| 3,340,054 | 9/1967 | Ward | 428/553 |

*Primary Examiner*—Brooks H. Hunt

*Attorney, Agent, or Firm*—Toren, McGeady and Stanger

[57] ABSTRACT

A stainless steel pipe having a surface layer with excellent resistance against vanadium pentoxide attack experienced upon boiler heating tubes for power generation, corrosion by sulfates, corrosion by chlorides experienced upon boiler heating tubes for various burning furnace and high-temperature gas corrosion experienced upon tubes for heating furnaces in the chemical industry, and also relates to methods for forming the surface layer.

2 Claims, 7 Drawing Figures

×: Acid Pickling Solution Remains

▲: Grains Grow

O: Good with no residual acid Pickling solution and no grain growth

X100

X100

STAINLESS STEEL PRODUCTS, SUCH AS SHEETS AND PIPES, HAVING A SURFACE LAYER WITH AN EXCELLENT CORROSION RESISTANCE AND PRODUCTION METHODS THEREFOR

BACKGROUND OF THE INVENTION

Field of the Invention

The present invention relates to stainless steel products, such as sheets and pipes, having a surface layer with an excellent corrosion resistance, particularly resistance against high temperature corrosion, and excellent adhesion with the base metal, said surface layer being composed of at least one selected from the group consisting of Fe, Cr, Ni, Ti, Mo, Nb, Co, their alloys and mixtures, and also relates to a method for forming the surface layer.

More particularly the present invention relates to a stainless steel pipe having a surface layer with excellent resistance against vanadium pentoxide attack experienced upon boiler heating tubes for power generation, corrosion by sulfates, corrosion by chlorides experienced upon boiler heating tubes for various burning furnace and high-temperature gas corrosion experienced upon tubes for heating furnaces in the chemical industry, and also relates to methods for forming the surface layer.

Stainless steel products, such as pipes and sheets, have been widely used in various boilers, burning furnaces, and chemical equipments for their high temperature strength and high temperature creep strength.

In recent years, from a point of saving energy consumption, the above furnaces and equipments have generally been operated at higher temperatures so that high temperature corrosion, such as vanadium pentoxide attack in the boilers, chloride attack in the burning furnaces, sulfate attack and attacks by $SO_2$ and $H_2S$ in the chemical processing equipment, has become more and more severe. Meanwhile, conventional stainless steels commonly used for these furnaces and equipments have shown an unsatisfactory resistance against the high-temperature corrosion, and general corrosive media have become severer. Therefore, stainless steel products, such as pipes and sheets having an improved corrosion resistance, particularly corrosion resistance at high temperatures have been sought for strongly.

High temperature equipments including boilers have been increasing in their size, and if the steel pipes used therein should burst due to corrosion, considerable human and material damages would be caused. Therefore, stainless steel products, such as pipes and sheets, having improved corrosion resistance have been in urgent demand.

Various trials and proposals have been made to improve corrosion resistance of the conventional steels by alloying with various elements, but these trials and proposals have been encountered by difficulties because of inherent limitations in the addition of the various elements from the aspect of the production requirements and have been unsuccessful in development of new steel grades.

Theoretically, corrosion resistance is a phenomenon inherent to the steel surface. Therefore, the most practical measure for prevention of corrosion resistance is to form a surface layer having an excellent corrosion resistance on the steel surface, and, in fact, various metal platings, metallizing, coating of various metal powders and spraying of various metals have been in practice.

However, metal platings and metallizings have demerits that the treating process is complicated and the treating time required for obtaining a necessary thickness of the surface layer is too long for commercial practice.

Meanwhile, coating of metal powders, and spraying of metals, although simple in their process and easy to form a desired thickness of the surface layer, have demerits that the surface layers as coated or as sprayed contains many voids and pores and satisfactory corrosion resistance can not be assured even when highly corrosion-resistant metals, alloys or their mixtures are used, and the adhesion between the surface layer and the base metal is not good.

Then various alloys called selffluxing alloy have been developed, which are alloys containing Cr, Ni, Si and B, and having a melting point between 1000° and 1200° C., and when these alloys in the powder form is sprayed on the base metal and heated to a temperature above their melting point, a surface layer is formed. In this case fusion can decrease flaws in the sprayed layer itself and assures tight adhesion of the sprayed layer to the base metal, thus providing a film having an excellent corrosion resistance and adhesion.

Therefore, the alloys to be sprayed should have a low melting point, and for this very reason, this method is limited in the alloy composition and have not been widely used for general purposes.

The present inventors have made various extensive studies on various stainless steel products by coating or spraying various metals, alloys or their mixtures on the stainless steel, subjecting thus coated or sprayed stainless steel products to high frequency heating under different conditions and to after-treatments, and the surface layers thus obtained have been examined. The results have revealed that an excellent corrosion resistance and adhesion between the surface layer and the base metal can be obtained when at least one selected from the group consisting of Fe, Cr, Ni, Ti, Mo, Nb and Co in the powder form is sprayed or coated on the base metal, and heated by high-frequency heating to form a sintered layer of 10$\mu$ to 20 mm thickness, and a diffusion layer of 1$\mu$ or more thickness by diffusion of the above metal or metals into the base stainless steel.

The present inventors have further made studies on various stainless steel pipes for boilers and heat exchangers by forming various surface layers thereon, and the following findings and results have been obtained.

DETAILED DESCRIPTION OF THE PREFERRED EMBODIMENT

Figure 2:
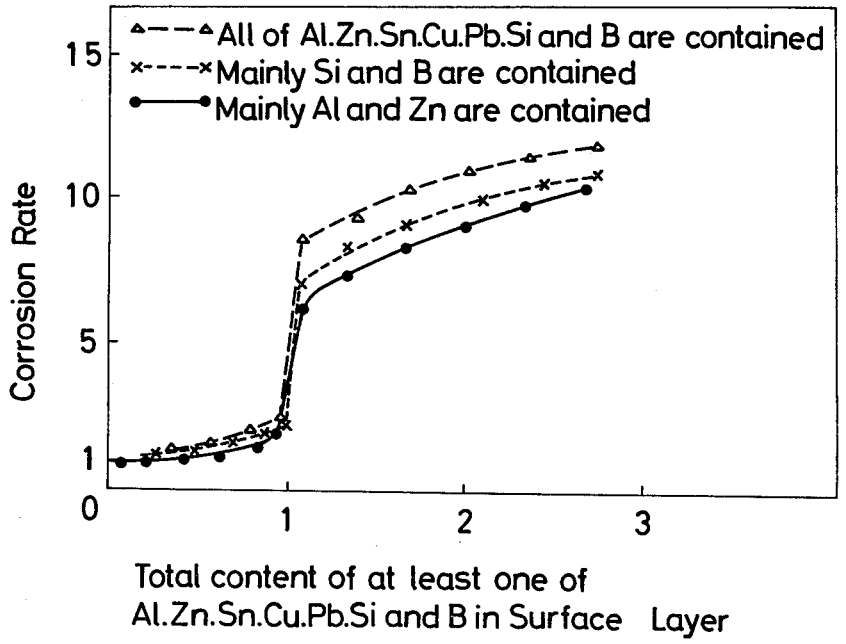
FIG. 2 shows the relation between the total content of one or more of Al, Zn, Sn, Cu, Pb, Si and B in the surface layer and the corrosion rate.
Figure 3:
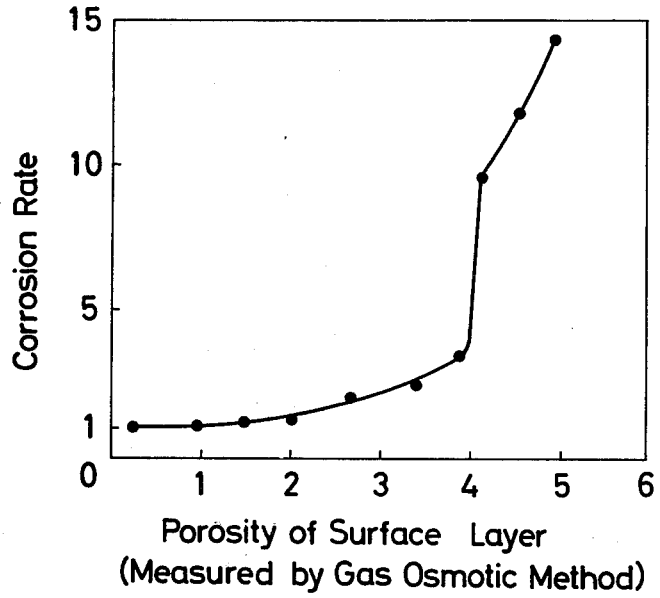
FIG. 3 shows the relation between the porosity of the surface layer and the corrosion rate.

For illustration, various surface layers composed mainly of Cr and Ni were formed in a thickness of 300μ on the outer surface of a stainless steel pipe (JIS-SUS 321 HTB), and a mixture of $V_2O_5$ and $Na_2SO_4$ in a ratio of 85 to 15 by weight was coated on the surface of the surface layers, which were heated at 650° C. for 200 hours to observe the vanadium pentoxide attack, representative for the high-temperature corrosion. The results are shown in FIG. 1 to FIG. 3.

Figure 1:
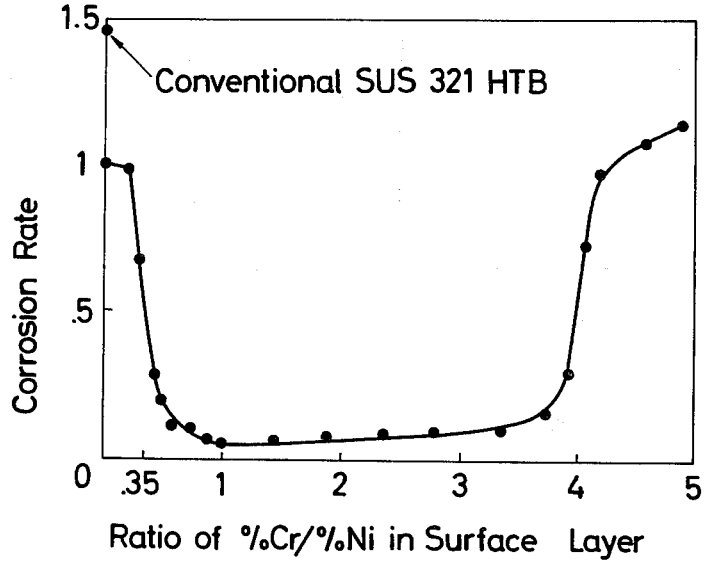
FIG. 1 shows the relation between the ratio of %Cr/%Ni in the surface layer and the corrosion rate.

When Cr and/or Ni is coated on the base metal, the corrosion resistance is improved, as shown in FIG. 1.

There is a certain relation between the corrosion resistance and the ratio of %Cr/%Ni in the surface layer, and the corrosion resistance is the best when the ratio is within the range of 0.35 to 4.0, thus $0.35 \leqq$ %Cr/%Ni $\leqq 4.0$. In this case, the total content of Al, Zn, Sn, Cu, Pb, Si and B in the surface layer was 0.1–0.3% and the porosity of the surface layer was 0.5–2.0%.

The elements, Al, Zn, Sn, Cu, Pb, Si and B come easily into the surface layer as impurities during coating of Cr and/or Ni on the base metal and often damage the corrosion resistance. FIG. 2 shows the effects of these elements, and in which when the total content of these elements in the surface layer exceeds 1.0%, the corrosion resistance lowers sharply. This result was obtained when the ratio of %Cr/%Ni in the surface layer was 0.78 to 0.82, and the porosity was 0.5 to 2.0%.

FIG. 3 shows the relation between the porosity of the surface layer and the corrosion resistance, where the corrosion resistance is improved when the porosity, namely voids, decreases, but a remarkable change is observed at 4% of the porosity. This result was obtained when the ratio of %Cr/%Ni was 0.78 to 0.82, and the total content of Al, Zn, Sn, Cu, Pb, Si and B in the surface layer was 0.1 to 0.3%.

Similar results and tendencies were obtained when other grades of stainless steels, such as SUS 304 HTB, SUS 347 HTB, SUS 316 HTB were used for the base metal.

Therefore, it has been revealed that a stainless steel product on which a surface layer is formed, with the ratio of %Cr/%Ni being within the range from 0.35 to 4.0, the total content of Al, Zn, Sn, Cu, Pb, Si and B being not larger than 1.0% and the porosity being not larger than 4.0%, has an excellent high temperature corrosion resistance as compared with any conventional stainless steel.

However, it has been found that these surface layers have a different thermal expansion coefficient as well as elongation from those of the base metal, so that their adhesion with the base metal is not good and they easily peel off in service.

Therefore, the present inventors have made further studies and discovered that when the component element or elements of the surface layer diffuses into the base metal to form a diffusion intersurfacial layer of at least 1μ in thickness between the surface layer and the base metal, excellent adhesion of the surface layer stable in actual service can be obtained.

Further, steel pipes to be used in the boilers and the heat exchangers are often subjected to bending and twisting, so that it is sometimes necessary that the surface layer also has an elongation of not less than 10%. In order to provide the required elongation, Co and Nb in single or in combination may be added to the surface layer. Improvements of elongation attained by the addition of these elements are shown in FIG. 4.

Figure 4:
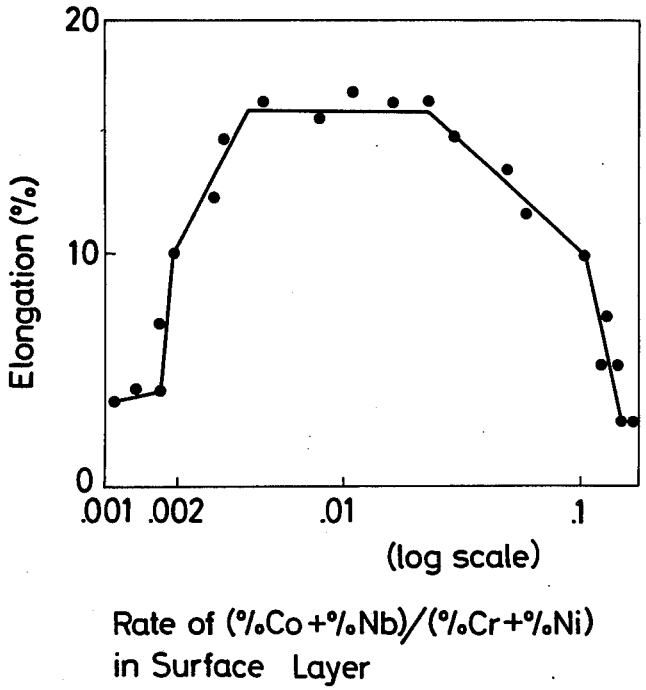
FIG. 4 shows the relation between the content of Co, Nb, Cr and Ni in the surface layer and the elongation of the surface layer.

FIG. 4 shows the relation between the content of Co, Nb, Cr, Ni in the surface layer, and the elongation, more particularly, relation between the ratio of (%Co+%Nb)/(%Cr+%Ni) and the elongation. In this case, the ratio of %Cr/%Ni was 1.0 to 1.1, the porosity was 2.2 to 2.3% and the total content of Al, Zn, Sn, Cu, Pb, Si and B was 0.3 to 0.5%.

As clearly shown in FIG. 4, when the total content of Co and/or Nb is within the range of $0.002 \leqq$ (%Co+%Nb)/(%Cr+%Ni) $\leqq 0.1$, the surface layer has an elongation of not less than 10% so far as the porosity is not more than 4% and the ratio of %Cr/%Ni is within the range from 0.35 to 4.0.

With the addition of Co and/or Nb, the corrosion resistance of the surface layer is also improved, and similar tendencies as shown in FIG. 1, FIG. 2 and FIG. 3 are seen in respect to the relation between the ratio of %Cr/%Ni and the corrosion resistance, the total content of Al, Zn, Sn, Cu Pb, Si and B and the corrosion resistance, and the relation between the porosity and the corrosion resistance.

The present invention has been completed on the basis of the above findings and knowledges and provides a stainless steel products having a high-temperature corrosion resistant surface layer with excellent adhesion. The features of the stainless steel product according to the present invention are set forth below.

(1) A stainless steel product having a surface layer of 10μ to 2 mm in thickness composed of at least one selected from the groups consisting of Fe, Cr, Ni, Ti, Mo, Nb, Co, and their alloys and a diffusion layer of at least 1μ in thickness formed by diffusion of at least one of the metals of the surface layer into the stainless steel product.

(2) A stainless steel product according to item (1), in which the surface layer has a porosity not more than 4.0%.

(3) A stainless steel product according to item (1), in which the surface layer is at least partially sintered.

(4) A stainless steel product with an excellent high temperature corrosion resistance, having a surface layer of 10μ to 2 mm in thickness, composed mainly of Cr and Ni within a range of $0.35 \leqq$ %Cr/%Ni $\leqq 4.0$ containing a total content of one or more of Al, Zn, Sn, Cu, Pb, Si and B in an amount of not more than 1.0%, and having a porosity of not more than 4.0%, and a diffusion layer of at least 1μ in thickness formed by diffusion of at least one of Cr and Ni into the stainless steel product.

(5) A stainless steel product according to item (4), in which the surface layer contains at least one of Co and Nb within a range of $0.002 \leqq$ (%Co+%Nb)/(%Cr+%Ni) $\leqq 0.1$.

In the present invention, the thickness of the surface layer is limited to the range from 10μ to 2 mm because if the surface layer of less than 10μ is to be formed, it happens often that the base metal surface is not wholly covered by the surface layer and the base metal surface is partially exposed, and in case of a surface layer of more than 2 mm thickness, it is difficult to maintain a porosity less than 4.0%.

The present invention has its further object to provide methods for forming the surface layer on stainless steel products.

Detailed descriptions will be made hereinafter on the method according to the present invention.

Formerly, the present inventors provided a new surface treatment method on the basis of findings that when various metals are sprayed on ordinary steels or low alloy steel pipes and sheets and heated to a temperature not lower than 1250° C. (measured at depth level of 0.2 mm below the surface) by high-frequency heating, the portion several ten microns below the surface becomes a molten or semi-molten state due to the skin effect inherent to the high frequency current, so that diffusion of the sprayed metals into the base metal is remarkably promoted.

Further studies by the present inventors have revealed that the high frequency heating produces the skin effect more remarkably when applied to similar surface treatments of stainless steel products under certain conditions than when applied to the ordinary steel or low alloy steel products.

The skin effect aimed to by the present invention is not such one in the order of several millimeters as used in the ordinary quenching, but is one of several microns to several ten microns in depth which has been discovered by the present inventors.

When powders of metals, such as Cr are coated or sprayed on surfaces of stainless steel products, and heated using a high frequency not lower than 0.1 KHz, to 1150° C. or higher at a position of 0.2 mm below the surface of the stainless steel product, the skin effect appears, and the portion several microns to several ten microns below the surface is melted or semimelted so that part of the metals coated or sprayed easily diffuses into the base stainless steel.

Simultaneously, part or whole of the surface layer coated or sprayed is sintered so that voids in the surface layer can be eliminated completely or decreased. Under the same heating temperature and time, other heating methods, such as heating in an electric furnace, produce no sintering or if any the degree is very small, leaving many voids in the surface layer. Thus, it is understood that the sintering takes place remarkably when the high frequency heating is applied, and has a close relation with the skin effect.

Therefore, the method for forming a surface layer on a stainless steel product according to the present invention has been completed on the basis of the above findings, and characterized in that at least one selected from the group consisting of Fe, Cr, Ni, Ti, Mo, Nb and Co and alloys of at least two of these metals in the powder form is sprayed or coated on a stainless steel product, such as pipe and sheet, to form a coating layer of 10μ to 2 mm in thickness thereon, then the coated or sprayed stainless steel product is heated to temperatures ranging from 1150° C. to 1480° C. for 0.01 second to 10 minutes by a high frequency ranging from 0.1 KHz to 500 KHz to sinter part or whole of the coating layer to form a surface layer, and part of the metals of the coating layer is diffused into the base stainless steel to form a diffusion layer, whereby a surface layer having an excellent high-temperature corrosion resistance and adhesion is formed on the stainless steel product.

When the coating layer is formed in a thickness ranging from 10μ to 2 mm, the surface layer formed by heating the coating layer will have a similar or slightly decreased thickness as compared with that of the coating layer depending on the nature of the coating layer.

In this point, it should be understood that the present invention is based on a completely different principle from that of prior art of surface treatments using self-fluxing alloy, where the sprayed layer of a low melting point is heated by ordinary heating means to improve the adhesion and corrosion resistance of the surface layer, but based on the diffusion and sintering of the coating layer utilizing the skin effect inherent to the high frequency heating, so that in the present invention, it is no more necessary that the coated or sprayed layer has a low melting point, and wide range of metals, alloys and their mixtures can be used.

According to further studies by the present inventors, it has been found that when the high-frequency heating is done in an oxidizing atmosphere, such as in air, the noncoated portions of the stainless steel product are oxidized so that acid pickling is often carried out after the heating, and in this case, the acid pickling solution penetrates into the surface layer if the sintering degree is low, and the solution can not be removed by rinsing and remains there to damage the surface layer, even in cases where a sintered surface layer has been formed by heating for 0.01 second or longer, and that if the heating is excessive, the grains, particularly grains near the surface of the base stainless steel become coarse remarkably as compared with those before the heating, thus deteriorating its mechanical properties, etc.

Then experiments were done with various high frequency heating temperatures and times, and some representative results thereof are shown in Table 1.

A mixture of Cr powder and Ni powder in a proportional ratio of 3 to 2 was sprayed 300μ in thickness on the surface of SUS 321 HTB stainless steel pipe of 50.8 mm in diameter, 8.0 mm in thickness and 6000 mm in length and subjected to high frequency heating under various conditions, then subjected to ordinary acid pickling in a 10% $HNO_3$ plus 3% HF solution and rinsing. When the stainless steel pipe thus treated is left in air, and if the acid pickling solution remains in the surface layer, it gradually flows out and can be observed by naked eyes after 2 days. In this way, the presence of residual acid pickling solution was determined. At the same time the grain growth in the base steel was investigated with an optical microscope. The results are shown in Table 1.

Figure 5:
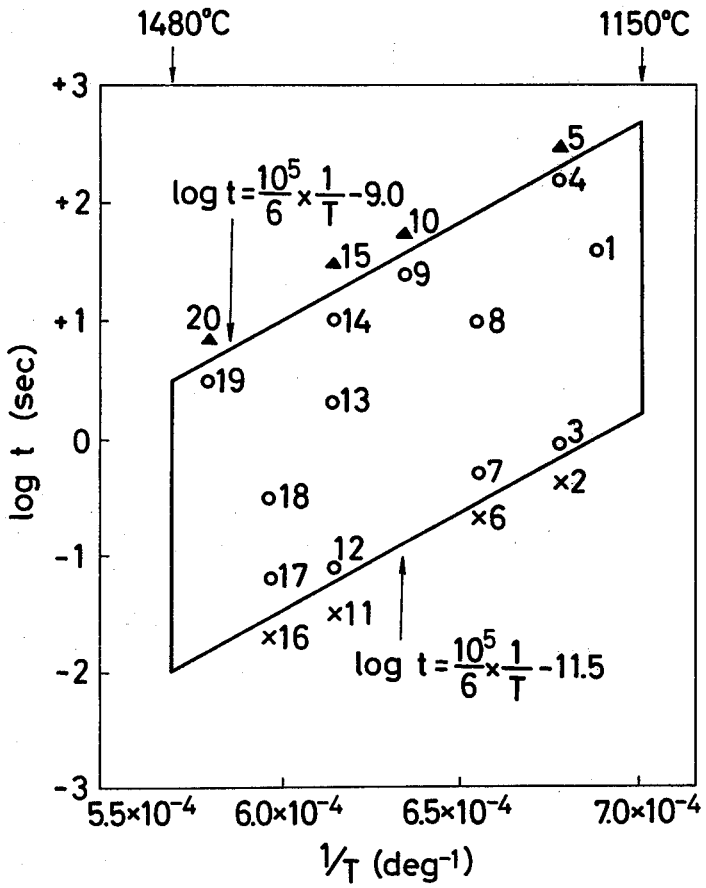
FIG. 5 shows the relation between the acid pickling property of the surface layer and the high frequency heating temperature and time, and the corelation of the base metal grain growth with the heating.

In view of the fact that both the sintering and the grain growth process are chemical reactions, the results in Table 1 are converted into inverse values of the heating temperature T expressed in an absolute temperature and logarithmic values of the heating time, as shown in FIG. 5, in which the mark x indicates that the solution remains, the mark Δ indicates that the grains become coarser, and the mark O indicates that both do not take place and the layer is satisfactory. The numerical figures in FIG. 5 correspond to those in Table 1. According to the results shown in FIG. 5 the sintering is enough and no acid pickling solution remains if the following condition is satisfied:

$$\log t \geqq \frac{10^5}{6} \times \frac{1}{T} - 11.5$$

where t is the heating time in second, and the grains do not substantially grow if the following condition is satisfied:

$$\log t \leqq \frac{10^5}{6} \times \frac{1}{T} - 9.0$$

Similar tendencies and results were obtained when other stainless steel grades were used or when other coating metals were used.

A modification of the method according to the present invention has been made on the basis of the above findings and knowledges, and this modification relates to the formation of a surface layer having an excellent corrosion resistance and adhesion on a stainless steel product, which is characterized in that at least one selected from the group consisting of Fe, Cr, Ni, Ti, Mo, Nb, Co and alloys composed of at least two thereof is coated or sprayed in a thickness of 2 mm or less on the surface of the stainless steel product, and heated with high frequency induction heating of 0.1 KHz to 500 KHz to temperatures ranging from 1150° to 1480° C. under the following condition:

$$\frac{10^5}{6} \times \frac{1}{T} - 11.5 \leqq \log t \leqq \frac{10^5}{6} \times \frac{1}{T} - 9.0$$

wherein t is the heating time in second and T is the heating temperature expressed in absolute temperature whereby part or whole of the coating layer is sintered and part of the coated or sprayed metal or metals diffuses into the stainless steel. According to this modification, the grains in the stainless steel do not substantially grow and the resultant surface layer is free from the residual acid pickling solution.

The coating layer as coated or sprayed has poor adhesion with the stainless steel and contains many voids therein so that only unsatisfactory corrosion resistance is anticipated. However, once this coating layer is heated with the high frequency heating utilizing the skin effect, part of the metal or metals in the coating layer diffuses into the base stainless steel, so that firm and rigid adhesion can be obtained, and simultaneously part or whole of the coating layer is sintered by the heating to reduce or eliminate the pore so that the corrosion resistance is improved remarkably.

In the method for forming the surface layer according to the present invention, each of Cr, Ni, Ti, Mo, Nb and Co can improve the corrosion resistance if it is coated in single or in an alloyed or mixed state with other metal or metals. Regarding to Fe, pure iron is sometimes superior to a stainless steel in respect of corrosion resistance, and powders of Cr, Ni, Ti, Mo, Nb and Co are often supplied in the form of ironalloys.

In the present invention, the lower limit of the thickness of the coating layer formed by spraying or coating is set at 10$\mu$ for the reason that a thickness below 10$\mu$, the resultant coating layer is not uniform and the base metal is often exposed locally. Meanwhile when the thickness exceeds 2 mm the skin effect of the high frequency heating does not have enough influence so that portions beyond 2 mm do not sinter substantially.

The lower limit of the frequency used in the high frequency heating is set at 0.1 KHz for the reason that a frequency less than 0.1 KHz does not produce enough skin effect in the stainless steel, and the upper limit is set at 500 KHz for the reason that a frequency beyond 500 KHz saturates the skin effect.

The heating temperature defined in the present invention is a temperature measured at a position about 0.2 mm below the stainless steel surface, and the lower limit is set at 1150° C. for the reason that temperatures below 1150° C. do not cause satisfactory sintering, and the upper limit of 1480° C. is specified for the reason that beyond this temperature, the stainless steel softens and deforms during the treatment and other problems tend to occur.

Regarding the heating time defined in the present invention, a heating time shorter than 0.01 second does not cause satisfactory diffusion and sintering and on the other hand, a heating time beyond 10 minutes does not produce any substantial increase of the sintering degree, but saturates it.

Meanwhile, it has been found that although satisfactory sintering is assured by a heating time of not shorter than 0.01 second so far as the high temperature corrosion resistance is concerned, in order to cause enough sintering for preventing the acid pickling solution from coming into the surface layer and remaining therein, which otherwise would damage the layer, it is preferable to satisfy the condition of $$\log t \geqq \frac{10^5}{6} \times \frac{1}{T} - 11.5$$

and in order to prevent the grain growth of the stainless steel which otherwise would deteriorate the mechanical properties, it is desirable to satisfy the condition of $$\log t \leqq \frac{10^5}{6} \times \frac{1}{T} - 9.0$$

In case of a stainless steel which is easily susceptible to material problems, when the heating is carried out at a temperature above 1150° C., it is possible to subject the stainless steel to a suitable heat treatment as required after the high frequency heating. For example, for SUS 304 or SUS 321 stainless steels, it is effective to subject the stainless steel to such heat treatment as heating between 1000 and 1200° C. followed by water quenching or forced air quenching. The scales formed by the heat treatment can be easily removed by acid pickling.

Also the same result can be obtained by water quenching or forced air quenching immediately after the high frequency treating without subsequent process.

The present invention is particularly effective to any stainless steel containing 12% or more of Cr, such as SUS 410, 413, 430, 304, 304L, 310S, 316, 316L, 321 and 347 stainless steels.

Also the method according to the present invention is applicable to part or whole of the surface of stainless steel products such as sheets, straight or bend pipes.

As for the coating method for the metal powders, they may be suspended or mixed in organic solvents such as an aqueous solution of polyvinyl alcohol, an aqueous solution of polymethaphosphate, a suspension of methylcellulose, glycol or water glass.

As for the spraying method, a plasma jet spraying and a gas spraying may be mentioned, and ordinary pretreatments such as brushing is done on the stainless steel surface prior to the spraying. The spraying may be done not only in air, but also under non-oxidizing atmosphere such as $N_2$ and Ar.

The high frequency heating may be carried out in air as well as under a non-oxidizing atmosphere such as $N_2$, Ar or under vacuum of $10^{-3}$ mmHg or less.

Further, oxides such as $Al_2O_3$ and $Cr_2O_3$ or ordinary oxidation inhibitors such as a mixture of $Cr_2O_3$, $SiO_2$, $Al_2O_3$, $Fe_2O_3$, etc. may be additionally sprayed on the coating layer as coated or sprayed, and then the high frequency heating can be carried out in air.

As described above, the present invention provides a stainless steel product having a surface layer with an excellent corrosion resistance and a diffusion layer between the surface layer and the base metal, and provides a method for forming a corrosion resistant surface layer on a stainless steel product, which comprises sintering a metal coating layer formed by coating or spraying by utilizing the skin effect inherent to the high frequency heating and diffusing part of the coating metal or metals into the stainless steel surface.

The present invention will be understood more clearly from the following descriptions of preferred embodiments.

EXAMPLE 1

A mixed powder of Cr and Ni in a ratio of 1 to 1 was plasma jet sprayed on the outer surface of SUS 321 HTB stainless steel pipe of 48.6 mm dia., 7.0 mm wall thickness and 5500 mm length, and the thus sprayed pipe was heated with a high frequency heating coil of 3 KHz by moving the coil at a constant speed so as to maintain the all portions of the pipe at 1350° C. for 10 seconds, and then the thus heated pipe was retreated in an electric furnace at 1130° C. for 2 minutes and water quenched. The resultant stainless steel pipe had a surface layer of 150μ thickness composed mainly of Cr and Ni with the ratio of %Cr/%Ni being 1.1, containing a total content of 0.3% of one or more of Al, Zn, Sn, Cu, Pb, Si and B and having a porosity of 1.5%, and had a diffusion layer formed by diffusion of Cr into the stainless steel to 70μ depth.

Figure 6:
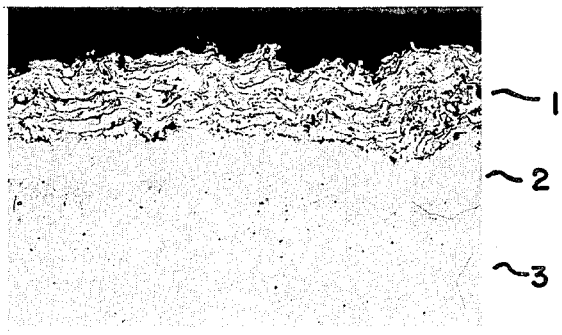
FIG. 6 is a microscopic photograph showing the cross section of the surface layer of the stainless steel pipe according to the present invention.

The cross sectional photograph of the resultant pipe is shown in FIG. 6, in which 1 is the surface layer, 2 is the diffusion layer and 3 is the base stainless steel. A mixture of $V_2O_5$ and $Na_2SO_4$ (mixing ratio=85 to 15) has coated on the surface of the resultant pipe, and the thus coated pipe was heated at 650° C. for 200 hours to determine the vanadium pentoxide attack thereon. The result revealed corrosion resistance more than 30 times better than that of the conventional SUS 321 HTB stainless steel. Also the surface layer showed excellent adhesion, and did not show any change after hammering.

EXAMPLE 2

A mixed powder of Cr and Ni (mixing ratio=3 to 1) was gas sprayed on the outer surface of SUS 347 HTB stainless steel pipe of 50.8 mm dia., 8.0 mm thickness and 6000 mm length and the thus sprayed pipe was heated with a high frequency heating coil of 8 KHz by moving the coil so as to maintain the all portions of the pipe at 1300° C. for 1 second, and immediately the thus heated pipe was water quenched, and immersed in a 10% $HNO_3$+1% HF solution for 30 minutes to descale. The resultant stainless steel pipe had a surface layer of 16μ in thickness, composed mainly of Cr and Ni with the ratio of %Cr/%Ni being 3.0, containing a total content of 0.4% of one or more of Al, Zn, Sn, Cu, Pb, Si and B and having a porosity of 2.4%, and had a diffusion layer formed by diffusion of Cr and Ni into the base stainless steel to 2μ depth.

$Na_2SO_4$ was coated on the resultant pipe surface, and heated at 700° C. for 200 hours to determine sulfate attack thereon. The result revealed corrosion resistance more than 25 times better than that of the conventional SUS 347 HTB stainless steel. Also the surface layer thus obtained showed very excellent adhesion, and did not peel off at all after more than 50 cycles of heating at 1100° C. for 2 minutes followed by water quenching.

EXAMPLE 3

A mixed powder of Cr, Ni and Nb (approximate mixing ratio=25 to 25 to 1) was coated on SUS 304 HTB stainless steel pipe of 70.0 mm dia., 5.0 mm thickness and 6000 mm length, and the thus coated pipe was heated at 1380° C. for 3 seconds under argon atmosphere using a frequency heating device of 80 KHz, and cooled naturally in air, then again heated at 1080° C. for 20 seconds and water quenched. The resultant stainless steel pipe had a surface layer of 450μ in thickness composed mainly of Cr and Ni with the ratio of %Cr/%Ni being 1.0 and the Nb content being (%Cr+%Ni)×0.02, containing a total content of 0.5% of one or more of Al, Zn, Sn, Cu, Pb, Si and B with 3.1% porosity and 14% elongation, and had a diffusion layer formed by Cr and Ni into the stainless steel to 34μ depth.

The outer surface of the resultant stainless steel pipe was exposed to an oil combustion gas at 800° C. for 30 days to determine the high temperature corrosion. The result revealed corrosion resistance more than 30 times better than that of the conventional SUS 304 HTB stainless steel. Also the resultant surface showed very excellent adhesion and did not peel off after 10% expansion.

EXAMPLE 4

A mixed powder of Cr and Ni and Co (approximate mixing ratio=150 to 50 to 1) was plasma jet sprayed under an argon atmosphere on SUS 316 LTB stainless steel pipe of 25.4 mm dia., 2.6 mm thickness and 6000 mm length, and the thus sprayed pipe was heated at 1250° C. for 30 seconds in vacuum of $1.1\times10^{-3}$ mmHg by high frequency heating with 3 KHz, and cooled naturally in air.

The resultant stainless steel pipe had a surface layer of 800μ in thickness composed of mainly of Cr and Ni with the ratio of %Cr/%Ni being 2.8 and the Co content being (%Cr+%Ni)×0.005, containing a total content of 0.2% of one or more of Al, Zn, Sn, Cu, Pb, Si and B, and having 2.2% porosity and 14% elongation and had a diffusion layer formed by diffusion of Cr into the stainless steel surface to 12μ depth.

The resultant stainless steel pipe was exposed to gas containing 3% $H_2S$ at 650° C. for 10 days to determine the high temperature corrosion. The result revealed corrosion resistance more than 25 times better than that of the conventional SUS 316 LTB stainless steel. The resultant surface layer showed very excellent adhesion with the base metal and did not peel off at all after 10% expansion.

EXAMPLE 5

A mixed powder of Cr, Ni, Co and Nb (approximate mixing ratio=6 to 12 to 1 to 1) was plasma jet sprayed on SUS 430 TB stainless steel pipe of 50.8 mm dia., 8.0 mm thickness and 6000 mm length, heated at 1250° C. for 1 minute using a high frequency heating coil of 200 KHz, and cooled naturally in air.

The resultant stainless steel pipe had a surface layer of 1.6 mm thickness, composed mainly of Cr and Ni with the ratio of %Cr/%Ni being 0.45 with a total content of Co and Nb being (%Cr+%Ni)×0.08 and containing one or more of Al, Zn, Sn, Cu, Pb, Si and B in a total amount not more than 0.1% with 3.1% porosity and 16% elongation, and had a diffusion layer formed by diffusion of Cr into the stainless steel to 52μ depth.

The resultant stainless steel pipe was exposed to gas at 900° C. containing 1% $SO_2$ and 5% $O_2$ for 30 days to determine the corrosion. The result revealed corrosion resistance more than 50 times better than that of the conventional SUS 430 TB stainless steel. The resultant surface layer did not peel off at all after 12% expansion.

EXAMPLE 6

Various metals, alloys and their mixtures were coated or sprayed on various grades of stainless steels, and thus coated or sprayed stainless steels were subjected to high frequency heating under various conditions, and further subjected to after-treatments. The resultant surface layers were investigated, and the results are shown in Table 2.

Also the resultant surface layers were observed by an optical microscope, and the results revealed that the surface layer showed excellent adhesion with the base metal when the thickness of the diffusion layer was 1μ or thicker, and the surface layer showed poor adhesion for practical use when the thickness of the diffusion layer was less than 1μ.

Therefore, in Table 2 indications are made whether the thickness of the diffusion layer is less than 1μ or not less than 1μ. The degree of sintering was also determined by the optical microscopic observation.

In Table 2, as a typical illustration of the high temperature corrosion, results of sulfate corrosion tests by $K_2SO_4$ and $Na_2SO_4$ are shown. For the tests, a mixture of $K_2SO_4$ and $Na_2SO_4$ are shown. For the tests, a mixture of $K_2So_4$ and $Na_2SO_4$ (1:1) is coated on the sample surface, heated in a heavy oil combustion exhaust gas at 600° C. for 200 hours, and the oxides thus formed are removed to determine the weight decrease by corrosion. The weight decrease by corrosion of the conventional stainless steels ranges from 800 to $1200^{mg}/cm^2$.

For evaluation of the corrosion resistance, it is judged where the corrosion resistance is 3 or more times better than the corrosion resistance of the conventional stainless steels.

Figure 7:
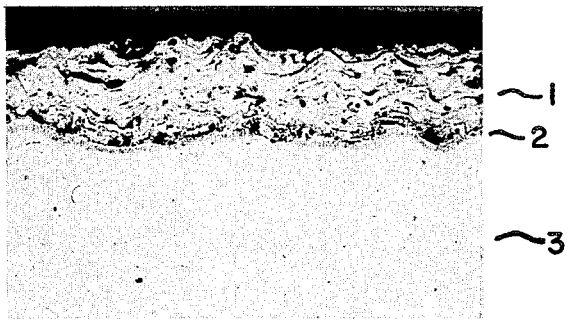
FIG. 7 is a microscopic photograph showing the cross section of the surface layer produced by the method of No. 26 in Table 2.

The cross sections of the surface layer obtained by the method according to No. 26 in Table 2 is shown in FIG. 7, where 1 is the sintered surface layer, 2 is the diffusion layer, and 3 is the base metal.

Nos. 1, 3, 5 and 7 in Table 2 represent the comparative methods, and the remainders represent the method according to the present invention. In any case of No. 1 where the high frequency heating temperature is outside the scope of the present invention, No. 3 where the frequency is outside the scope of the present invention and No. 7 where the high frequency heating time is outside the scope of the present invention, the diffusion layer does not develop to 1μ or thicker, so that the resultant surface layers show poor adhesion, and unsatisfactory degree of sintering, and thus the stainless steel pipes or sheets treated by these methods show only poor high temperature corrosion resistance.

In case of No. 5 method where the coating layer thickness is outside the scope of the present invention, the surface of the stainless steel is only partially coated, thus showing unsatisfactory high temperature corrosion resistance.

Whereas, the surface layers produced by the method of the present invention are sintered well, and contain remarkably reduced pores or no pore at all, and the stainless steel pipes or sheets having these surface layers show corrosion resistance 3 or more times better than that of the conventional stainless steels, and show good adhesion of the surface layer to the base metal due to the diffusion layer of 1μ or more in thickness.

EXAMPLE 7

Various metals, alloys and their mixtures were coated or sprayed on various stainless steel grades, and subjected to high frequency heating under various conditions, and after-treatments to form surface layers. Then investigations were made to see if an aqueous solution of 10% $HNO_3$+2% HF got into the layer and remained there. The results are shown in Table 3. Also optical microscopic observations were made on the cross sections of the steel products thus treated to see if there was a diffusion layer of not less than 1μ in thickness and to see if there was caused the grain growth by the heating. The results are shown in Table 3.

In No. 1 to No. 10 of Table 3, a steel pipe of 50.8 mm dia., 6.5 mm thickness and 6000 mm length was used, in No. 11 to No. 16 a steel pipe of 48.6 mm dia., 6.0 mm thickness and 5500 mm length was used, in No. 17 to No. 20, No. 22 and No. 23 a steel sheet of 10 mm thickness, 1000 mm width and 2000 mm length was used, and in No. 21 and No. 24 to No. 26 a steel pipe of 57.1 mm dia., 8.0 mm thickness and 6000 mm length was used.

Regarding the coating layer formation, plasma jet spraying was used in No. 1 to No. 10, and No. 22 to No. 26, in No. 11 to No. 16 gas spraying was used, and in No. 17 to No. 21 the metal powder mixed with an organic binder was applied.

In Table 3, vanadium pentoxide attack tests using $V_2O_5$ and $Na_2SO_4$ were carried out for determining the high temperature corrosion. Thus a mixture of $V_2O_5$ and $Na_2SO_4$ (85 to 15) was applied on the sample surface, and heated at 650° C. for two weeks to see if the corrosion resistance 3 or more times better than that of non-treated SUS 321 stainless steel was obtained.

Nos. 1, 3, 5, 7, 9, 11 and 13 in Table 3 are comparison methods, and the remainders are within the scope of the present invention.

In No. 1 where the high frequency heating temperature is outside the scope of the present invention, and in No. 3, where the frequency is outside the scope of the present invention, the thickness of the resultant diffusion layer was less than 1μ and the surface layer showed poor adhesion and low high temperature corrosion resistance. In No. 5 where the thickness of the coating layer was outside the scope of the present invention, the surface of the base stainless steel was only partially coated and only poor high temperature corrosion resistance was obtained.

In No. 7, where the heating time was shorter than the range defined in the present invention, the acid pickling solution penetrated into the surface layer and remained there, thus prohibiting acid pickling.

In No. 9 and No. 13 where the heating time was longer than the range defined in the present invention, the grains of the base stainless steel grew remarkably as compared with those before the heating.

Whereas, the steel products treated according to the present invention showed satisfactory high temperature corrosion resistance with excellent adhesion of the surface layer to the base metal due to the development of a 1μ or thicker diffusion layer, and the surface layer showed no penetration or remaining of the acid pickling solution therein and also the base steel showed no grain growth due to the heating.

As described above, the present invention provides a stainless steel product having a surface layer composed mainly of Cr and Ni with restricted content of one or more of impurities of Al, Zn, Sn, Cu, Pb, Si and B and with a restricted porosity, and having a diffusion layer between the surface layer and the base metal, and also provides a method for forming the above stainless steel product where powder of one or more of Fe, Cr, Ni, Ti, Nb, Mo, Co and their alloys is coated or sprayed on the stainless steel product, and subjected to high frequency heating utilizing the skin effect to sinter part or whole of the coating layer thereby reducing or eliminating the pores in the coating layer, and to diffuse part of the coating metal or metals into the base metal thereby enhancing the adhesion of the surface layer with the base metal.

The stainless steel products according to the present invention are particularly advantageous for structural components of boilers, and heat exchangers which are exposed to high temperature corrosion.

The present invention has been described mainly in connection with the stainless steel pipes and sheets, but may be applicable to other various types of stainless steel products.

Table 1

High Frequency Heating Conditions, Residual Acid Pickling Solution and Grain Growth

| | | Base Metal SUS 321 HTB Cr + Ni (3 : 2) 300μSpraying | | |
|---|---|---|---|---|
| No. | Heating Temperature (°C.) | Heating Time (second) | Residual Acid Pickling Solution O:No; X:Yes | Grain Growth O:almost not observed Δ:observed |
| 1 | 1180 | 40 | O | O |
| 2 | 1200 | 0.4 | X | O |
| 3 | " | 0.9 | O | O |
| 4 | " | 160 | O | O |
| 5 | " | 300 | O | Δ |
| 6 | 1250 | 0.2 | X | O |
| 7 | " | 0.5 | O | O |
| 8 | " | 10 | O | O |
| 9 | 1300 | 24 | O | O |
| 10 | " | 55 | O | Δ |
| 11 | 1350 | 0.03 | X | O |
| 12 | " | 0.07 | O | O |
| 13 | " | 2 | O | O |
| 14 | " | 10 | O | O |
| 15 | " | 30 | O | Δ |
| 16 | 1400 | 0.02 | X | O |
| 17 | " | 0.06 | O | O |
| 18 | " | 0.3 | O | O |
| 19 | 1450 | 3 | O | O |
| 20 | " | 7 | O | Δ |

Table 2 - (1)

Base Stainless Steels, Coating Layers and High Frequency Heating Conditions

| | Base Stainless Steels | | Coating Layers | | |
|---|---|---|---|---|---|
| No. | Grades * | Shapes (mm) | Coating Metal Powder | Coating Method | Thickness |
| X 1 | SUS304HTB | Pipe 48.6dia. × 6.5t × 5,500 | Cr | Plasma jet spraying | 200μ |
| 2 | " | Pipe 48.6dia. × 6.5t × 5,500 | Cr | Plasma jet spraying | 200μ |
| X 3 | " | Pipe 48.6dia. × 6.5t × 5,500 | Cr | Plasma jet spraying | 200μ |
| 4 | " | Pipe 48.6dia. × 6.5t × 5,500 | Cr | Plasma jet spraying | 200μ |
| X 5 | " | Pipe 48.6dia. × 6.5t × 5,500 | Cr | Plasma jet spraying | 8μ |
| 6 | " | Pipe 48.6dia. × 6.5t × 5,500 | Cr | Plasma jet spraying | 12μ |
| X 7 | " | Pipe 48.6dia. × 6.5t× 5,500 | Cr | Plasma jet spraying | 200μ |
| 8 | " | Pipe 48.6dia.× 6.5t × 5,500 | Cr | Plasma jet spraying | 200μ |
| 9 | SUS 410 | Sheet 12t × 1000 × 2000 | Fe—Cr(40:60) | Gas Spraying | 100μ |
| 10 | SUS 430 | " | Ti | Coated with water glass | 400μ |

X Comparison Method
*:according to JIS standards
**:Measured at 0.2mm below the stainless steel surface Table 2 - (2)

After-Treatment Conditions, Resultant Surfaces and High-Temperature Corrosion Resistance

| | High-Frequency Heating Conditions | | | | Surface | | |
|---|---|---|---|---|---|---|---|
| No. | Frequency | Temperature** | Time (sec.) | After-Treatment | Thickness of Diffusion Layer O:1μ or more X:less than 1μ | Sintering Degree O:enough X:not enough | High-Temperature Corrosion Resistance Coated with $K_2SO_4$ + $Na_2SO_4$ at 600° C., 200 hours O:3 or more times better than the conventional stainless steels X:less than 3 times better than the conventional stainless steel |
| X 1 | 3KHz | 1130° C. | 20 | Heated at 1080° C. for 5 minutes then water quenched | X | X | X |
| 2 | 3KHz | 1170 | 20 | Heated at 1080° C. for 5 minutes then water quenched | O | O | O |
| | | | | Heated at 1080° C. | | | |

Table 2 - (2)-continued

| No. | High-Frequency Heating Conditions: Frequency | Temperature** | Time (sec.) | After-Treatment | After-Treatment Conditions, Resultant Surfaces and High-Temperature Corrosion Resistance: Surface: Thickness of Diffusion Layer O:1μ or more X:less than 1μ | Sintering Degree O:enough X:not enough | High-Temperature Corrosion Resistance Coated with $K_2SO_4 + Na_2SO_4$ at 600° C., 200 hours O:3 or more times better than the conventional stainless steels X:less than 3 times better than the conventional stainless steel |
|---|---|---|---|---|---|---|---|
| X 3 | 0.08KHz | 1250 | 10 | for 5 minutes then water quenched | X | X | X |
| 4 | 0.12KHz | 1250 | 10 | Heated at 1080° C. for 5 minutes then water quenched | O | O | O |
| X 5 | 3KHz | 1250 | 10 | Heated at 1080° C. for 5 minutes then water quenched | Locally no surface layer | | X |
| 6 | 3KHz | 1250 | 10 | Heated at 1080° C. for 5 minutes then water quenched | O | O | O |
| X 7 | 3KHz | 1250 | shorter than 0.01 sec. | Heated at 1080° C. for 5 minutes then water quenched | X | X | X |
| 8 | 3KHz | 1250 | 0.02 | Heated at 1080° C. for 5 minutes then water quenched | O | O | O |
| 9 | 0.5KHz | 1300 | 1 | Heated at 980° C. for 10 min. then water quenched | O | O | O |
| 10 | 0.5KHz | 1300 | 1 | Heated at 800° C. for 1 hr. then air quenched | O | O | O |

X Comparison Method
*:according to JIS standards
**:Measured at 0.2mm below the stainless steel surface Table 2 - (3)

| No. | Base Stainless Steels: Grade* | Shapes(mm) | Coating Layers: Coating Metal Powder | Coating Method | Thickness |
|---|---|---|---|---|---|
| 11 | SUS 430 | Sheet 12t × 1000 × 2000 | Ni | Suspension coat- | 500μ |
| 12 | SUS 304 L | " | Mo | Gas spraying | 200μ |
| 13 | " | " | Nb | Coated with organic binder plasma jet spraying | 600μ |
| 14 | SUS 310 S | Sheet 6t × 1000 × 2000 | Co | Plasma jet spraying | 300μ |
| 15 | SUS 316 HTB | Pipe 25.4 dia. × 2.3t × 5500 | Cr − Ni(60:40) | " | 250μ |
| 16 | " | Pipe 25.4 dia × 2.3t × 5500 | Cr − Nb(90:10) | " | 250μ |
| 17 | SUS 316 LTP | Pipe 34.0 dia. × 2.8t × 5500 | Cr + Nb(80:20) | " | 200μ |
| 18 | " | Pipe 34.0 dia. × 2.8t × 5500 | Cr + Co(90:10) | " | 100μ |
| 19 | SUS 321 TB | Pipe 48.6 dia. × 7.0t × 5500 | Cr + Ti(60:40) | " | 1.8 mm |
| 20 | " | Pipe 48.6 dia. × 7.0t × 5500 | Cr + Ni + Nb(60:35:5) | " | 1.0 mm |

*:according to JIS standards
**:Measured at 0.2mm below the stainless steel surface Table 2 - (4)

| No. | High-Frequency Heating Conditions: Frequency | Temperature (°C.)** | Time (sec.) | After-Treatment | Surface: Thickness of Diffusion Layer O:1μ or more X:less than 1μ | Sintering Degree O:enough X:not enough | High-Temperature Corrosion Resistance Coated with $K_2SO_4 + Na_2SO_4$ at 600° C. 200 hours O:3 or more times better than the conventional stainless steels X:less than 3 times better than the conventional stainless steel |
|---|---|---|---|---|---|---|---|
| 11 | 1 KHz | 1350 | 2 | No | O | O | O |
| 12 | 1 KHz | 1200 | 5 | Heated at 1080° C. for 10 min. then water quenched | O | O | O |
| 13 | 1 KHz | 1200 | 9(min.) | No | O | O | O |
| 14 | 320 KHz | 1300 | 0.2 | Heated at 1120° C. | O | O | O |

Table 2 - (4)-continued

| No. | High-Frequency Heating Conditions: Frequency | Temperature (°C.)** | Time (sec.) | After-Treatment | Surface: Thickness of Diffusion Layer O:1μ or more X:less than 1μ | Sintering Degree O:enough X:not enough | High-Temperature Corrosion Resistance: Coated with $K_2SO_4$ + $Na_2SO_4$ at 600° C. 200 hours O:3 or more times better than the conventional stainless steels X:less than 3 times better than the conventional stainless steel |
|---|---|---|---|---|---|---|---|
| | | | | for 5 min. then water quenched | | | |
| 15 | 10 KHz | 1350 | 2 | Heated at 1080° C. for 5 min. then water quenched | O | O | O |
| 16 | 10 KHz | 1 2 | | Forcedly air quenched immediately after high frequency heating | O | O | O |
| 17 | 10 KHz | 1300 | 5(min.) | Forcedly air quenched immediately after high frequency heating | O | O | O |
| 18 | 10 KHz | 1450 | 0.1 | No | O | O | O |
| 19 | 5 KHz | 1400 | 1 | Water quenched immediately after high frequency heating | O | O | O |
| 20 | 5 KHz | 1200 | | Water quenched immediately after high frequency heating | O | O | O |

X Comparison Method
*:according to JIS standards
**:Measured at 0.2mm below the stainless steel surface Table 2 - (5)

| No. | Base Stainless Steels: Grade * | Shapes (mm) | Coating Layers: Coating Metal Powder | Coating Method | Thickness |
|---|---|---|---|---|---|
| 21 | SUS 321 TB | Pipe 48.6 dia. × 7.0t × 5500 | Cr + Ni + Mo(60:35:5) | Plasma jet spraying | 500 μ |
| 22 | SUS 321 HTB | Pipe 48.6 dia. × 7.0t × 5500 | Cr + Ni (50:50) | " | 300 μ |
| 23 | " | Pipe 48.6 dia. × 7.0t × 5500 | Ni + Mo (80:20) | Gas spraying | 200 μ |
| 24 | " | Pipe 48.6 dia. × 7.0t × 5500 | Ni + Nb + Co (60:20:20) | " | 250 μ |
| 25 | " | Pipe 48.6 dia. × 7.0t × 5500 | Cr + Ni + Co (40:55:5) | Plasma jet spraying | 300 μ |
| 26 | " | Pipe 48.6 dia. × 7.0t × 5500 | Cr + Mo (80:20) | " | 160 μ |
| 27 | SUS 347 TB | Pipe 50.8 dia. × 8.0t × 5500 | Nb − Ti − Co (10:5:85) | " | 300 μ |
| 28 | SUS 347 HTB | Pipe 50.8 dia. × 8.0t × 5500 | Cr + Ni (60:40) | " | 300 μ |
| 29 | " | Pipe 50.8 dia. × 8.0t × 5500 | Cr | " | 250 μ |

*:according to JIS standards
**:Mesasured at 0.2mm below the stainless steel surface Table 2 - (6)

| No. | High-Frequency Heating Conditions: Frequency | Temperature (C.)** | Time (sec.) | After-Treatment | Surface: Thickness of Diffusion Layer O-1μ or more X:less than 1μ | Sintering Degree O:enough X:not enough | High-Temperature Corrosion Resistance: Coated with $K_2SO_4$ + $Na_2SO_4$ at 600° C., 200 hours O:3 or more times better than the conventional stainless steels X:less than 3 times better than the conventional stainless steel |
|---|---|---|---|---|---|---|---|
| 21 | 120 KHz | 1320 | 0.1 | Water quenched immediately after high frequency heating | O | O | O |
| 22 | 3 KHz | 1350 | 10 | Heated at 1120° C. for 2 min. then water quenched | O | O | O |
| 23 | 80 KHz | 1250 | 2 | Heated at 1120° C. for 2 min. then water quenched | O | O | O |
| 24 | 3 KHz | 1300 | 1 | Heated at 1120° C. | O | O | O |

Table 2 - (6)-continued

| No. | High-Frequency Heating Conditions: Frequency | Temperature (C.)** | Time (sec.) | After-Treatment | Surface: Thickness of Diffusion Layer O-1μ or more X:less than 1μ | Surface: Sintering Degree O:enough X:not enough | High-Temperature Corrosion Resistance Coated with $K_2SO_4$ + $Na_2SO_4$ at 600° C., 200 hours O:3 or more times better than the conventional stainless steels X:less than 3 times better than the conventional stainless steel |
|---|---|---|---|---|---|---|---|
| | | | | for 2 min. then water quenched | | | |
| 25 | 5 KHz | 1350 | 1 | No | O | O | O |
| 26 | 3 KHz | 1300 | 10 | " | O | O | O |
| 27 | 3 KHz | 1350 | 2 | Heated at 1110° C. for 5 min. then water quenched | O | O | O |
| 28 | 5KHz | 1350 | 2 | Heated at 1110° C. for 5 min. then water quenched | O | O | O |
| 29 | 5 KHz | 1300 | 8 | Heated at 1110° C. for 5 min. then water quenched | O | O | O |

X Comparison Method
*:according to JIS standards
**:Measured at 0.2mm below the stainless steel surface Table 3 - (1)

| | Base Metal, Coating Layer, High Frequency Heating, After Treatment, Residual Acid Pickling Solution, Diffusion Layer, Grain Growth and High Temperature Corrosion Resistance: Base Stainless Steels | | Coating Layer: Coating Metals | Coating Layer: Thickness | High Frequency Heating Frequency |
|---|---|---|---|---|---|
| X 1 | SUS 304 HTB | | Cr | 300 μ | 5 KHz |
| 2 | " | | Cr | 300 μ | 5 KHz |
| X 3 | " | | Cr | 200 μ | 0.08 KHz |
| 4 | " | | Cr | 200 μ | 0.13 KHz |
| X 5 | " | | Cr | 7 μ | 5 KHz |
| 6 | " | | Cr | 12 μ | 5 KHz |
| X 7 | " | | Cr | 150 μ | 10 KHz |
| 8 | " | | Cr | 150 μ | 10 KHz |
| X 9 | " | | Cr | 150 μ | 10 KHz |
| 10 | " | | Cr | 150 μ | 10 KHz |
| X 11 | SUS 321 HTB | Cr + Ni | (1:1) | 300 μ | 3 KHz |
| 12 | " | Cr + Ni | (1:1) | 300 μ | 3 KHz |
| X 13 | " | Cr + Ni | (1:1) | 300 μ | 3 KHz |
| 14 | " | Cr + Ni | (1:1) | 300 μ | 3 KHz |
| 15 | " | Cr + Ni | (1:1) | 300 μ | 3 KHz |
| 16 | " | Cr + Ni | (1:1) | 300 μ | 3 KHz |
| 17 | SUS 410 | | Ni | 50 μ | 30 KHz |
| 18 | SUS 430 | | Ti | 80 μ | 1 KHz |
| 19 | SUS 304 L | | Mo | 1.5mm | 1 KHz |
| 20 | SUS 310 S | | Nb | 600 μ | 15 KHz |
| 21 | SUS 316 HTB | | Co | 600 μ | 30 KHz |
| 22 | SUS 316 L | Fe − Cr | (2:3) | 100 μ | 180 KHz |
| 23 | " | Cr + Mo | (3:1) | 100 μ | 400 KHz |
| 24 | SUS 347 HTB | Cr + Ni + Nb | (5:5:1) | 600 μ | 100 KHz |
| 25 | " | Cr + Ti | (10:1) | 600 μ | 100 KHz |
| 26 | SUS 321 TB | Cr + Ni | (3:2) | 200 μ | 0.5 KHz |

X = Comparison Method

Table 3 - (2)

| Temperature (°C.) | High Frequency Heating: t value calculated from $\log t = \frac{10^5}{6} \times \frac{1}{T} - 11.5$ | t value calculated from $\log t = \frac{10^5}{6} \times \frac{1}{T} - 9.0$ | Actual Heating Time (second) | After Treatment |
|---|---|---|---|---|
| | (second) | (second) | | |
| 1130 | — | — | 30 | Heating at 1080° C. for 5 min. then water quenched |
| 1170 | 1.1 | 355 | 30 | Heating at 1080° C. for 5 min. then water quenched |

Table 3 - (2)-continued

| High Frequency Heating | | | | |
|---|---|---|---|---|
| Temperature (°C.) | t value calculated from $\log t = \frac{10^5}{6} \times \frac{1}{T} - 11.5$ | t value calculated from $\log t = \frac{10^5}{6} \times \frac{1}{T} - 9.0$ | Actual Heating Time (second) | After Treatment |
| 1300 | 0.12 | 38 | 15 | Heating at 1080° C. for 5 min. then water quenched |
| 1300 | 0.12 | 38 | 15 | Heating at 1080° C. for 5 min. then water quenched |
| 1300 | 0.12 | 38 | 15 | Heating at 1080° C. for 5 min. then water quenched |
| 1300 | 0.12 | 38 | 15 | Heating at 1080° C. for 5 min. then water quenched |
| 1250 | 0.27 | 86 | 0.2 | Heating at 1080° C. for 5 min. then water quenched |
| 1250 | 0.27 | 86 | 0.4 | Heating at 1080° C. for 5 min. then water quenched |
| 1250 | 0.27 | 86 | 93 | Heating at 1080° C. for 5 min. then water quenched |
| 1250 | 0.27 | 86 | 80 | Heating at 1080° C. for 5 min. then water quenched |
| 1350 | 0.058 | 19 | 0.04 | Heating at 1060° C. for 10 min. then water quenched |
| 1350 | 0.058 | 19 | 0.07 | |
| 1350 | 0.058 | 19 | 24 | Heating at 1060° C. for 10 min. then water quenched |
| 1350 | 0.058 | 19 | 17 | Heating at 1060° C. for 10 min. then water quenched |
| 1350 | 0.058 | 19 | 2 | Heating at 1060° C. for 10 min. then water quenched |
| 1350 | 0.058 | 19 | 8 | Heating at 1060° C. for 10 min. then water quenched |
| 1200 | 0.64 | 200 | 1 | Heating at 800° C. for 1 hr. then air quenched |
| 1200 | 0.64 | 200 | 170 | |
| 1300 | 0.12 | 38 | 0.5 | no |
| 1300 | 0.12 | 38 | 2 | no |
| 1300 | 0.12 | 38 | 20 | no |
| 1400 | 0.028 | 9 | 0.1 | no |
| 1400 | 0.028 | 9 | 0.1 | After High frequency heating, then water quenched |
| 1400 | 0.028 | 9 | 3 | |
| 1450 | 0.014 | 4.7 | 0.05 | |
| 1450 | 0.014 | 4.7 | 1 | |

Table 3 - (3)

| Residual Acid Pickling Solution in Surface Layer O:Yes X:No | Thickness of Diffusion Layer O:1μ or thicker X:less than 1μ | Grain Growth of Base Stainless Steel O:No X:Observed | High Temperature Corrosion Resistance coated with $V_2O_5$ $Na_2SO_4$ heated at 650° C. at 2 weeks O:3 or more times better than SUS 321 X:less than 3 times better than SUS 321 |
|---|---|---|---|
| No | X | not investigated | 0 |
| O | O | O | O |
| No | X | not investigated | X |
| O | O | O | O |
| Locally no Surface Layer | | O | X |

Table 3 - (3)-continued

| Residual Acid Pickling Solution in Surface Layer O:Yes X:No | Thickness of Diffusion Layer O:1μ or thicker X:less than 1μ | Grain Growth of Base Stainless Steel O:No X:Observed | High Temperature Corrosion Resistance coated with $V_2O_5$ $Na_2SO_4$ heated at 650° C. at 2 weeks O:3 or more times better than SUS 321 X:less than 3 times better than SUS 321 |
|---|---|---|---|
| O | O | O | O |
| X | O | O | O |
| O | O | O | O |
| O | O | X | O |
| O | O | O | O |
| X | O | O | O |
| O | O | O | O |
| O | O | X | O |
| O | O | O | O |
| O | O | O | O |
| O | O | O | O |
| O | O | O | O |
| O | O | O | O |
| O | O | O | O |
| O | O | O | O |
| O | O | O | O |
| O | O | O | O |
| O | O | O | O |
| O | O | O | O |
| O | O | O | O |
| O | O | O | O |

What is claimed is:

1. A stainless steel product with an excellent high temperature corrosion resistance against vanadium pentoxide and sodium sulfate, having a surface layer of 10μ to 2 mm in thickness, composed mainly of Cr and Ni within a range of $0.35 \leqq \%Cr/\%Ni \leqq 4.0$ containing one or more elements selected from the group consisting of Al, Zn, Sn, Cu, Pb, Si and B in a total amount of not more than 1.0%, and having a porosity of not more than 4.0%, and a diffusion layer of at least 1μ in thickness formed by diffusion of at least one element selected from the group consisting of Cr and Ni into the base metal at the interface between the surface layer and the base metal.

2. A stainless steel product according to claim 1 in which the surface layer contains at least one element selected from the group consisting of Co and Nb within a range of $0.002 \leqq (\%Co+\%Nb)/(\%Cr+\%Ni) \leqq 0.1$.

* * * * *